US006652289B2

(12) United States Patent
Bae

(10) Patent No.: US 6,652,289 B2
(45) Date of Patent: Nov. 25, 2003

(54) VEHICLE DOOR CONNECTOR STRUCTURE

(75) Inventor: Hyun-Cheol Bae, Kyungki-Do (KR)

(73) Assignee: Hyundai Motor Company, Seoul (KR)

( * ) Notice: Subject to any disclaimer, the term of this patent is extended or adjusted under 35 U.S.C. 154(b) by 0 days.

(21) Appl. No.: 10/325,816

(22) Filed: Dec. 18, 2002

(65) Prior Publication Data

US 2003/0119339 A1 Jun. 26, 2003

(30) Foreign Application Priority Data

Dec. 24, 2001 (KR) ..... 10-2001-83966

(51) Int. Cl.[7] ..... H01R 33/00

(52) U.S. Cl. ..... 439/34; 439/548

(58) Field of Search ..... 439/34, 314–319, 439/332–335, 546, 548, 549, 550, 551, 556, 277, 271, 367, 559, 587, 588, 565

(56) References Cited

U.S. PATENT DOCUMENTS

| | | | | |
|---|---|---|---|---|
| 4,862,011 A | | 8/1989 | Wright | |
| 5,233,731 A | | 8/1993 | Phillips | |
| 5,248,259 A | | 9/1993 | Naito et al. | |
| 5,279,507 A | | 1/1994 | Kameyama | |
| 5,662,488 A | * | 9/1997 | Alden | 439/314 |
| 6,039,523 A | | 3/2000 | Kraus | |
| 6,290,537 B1 | * | 9/2001 | Sommer | 439/559 |

* cited by examiner

*Primary Examiner*—Ross Gushi
(74) *Attorney, Agent, or Firm*—Pennie & Edmonds LLP

(57) ABSTRACT

A vehicle door connector structure, in which the connector structure is easily and firmly coupled to a vehicle body to secure a tight sealing and prevent water leakage between the vehicle body and the connector structure. The connector structure also prevents vibration and noise, improves assembly efficiency and maintenance of associated components. Furthermore, the connector structure reduces the possibility of door wires being exposed to any sharp structural objects causing a short circuit.

10 Claims, 4 Drawing Sheets

VEHICLE DOOR CONNECTOR STRUCTURE

FIELD OF THE INVENTION

Generally, the present invention relates to a vehicle door connector structure for providing a variety of electric signals into a vehicle door. More particularly, the present invention relates to a connecting structure capable of conveniently connecting and disconnecting a plurality of wires between a vehicle body and door.

BACKGROUND OF THE INVENTION

Connectors for easily connecting and disconnecting electrical devices have been long known and used. These connectors increase the efficiency of assemblage and handling of electrical units by dividing functions into performing modules. Furthermore, upon the failure of a particular unit, one only need replace the defective module, which is quick and cost-effective. A variety of these types of connectors are utilized in vehicles. For instance, a connector is used to transfer electric signals between the door and body of a vehicle.

Typically, the vehicle door connector structure includes a male connector extracted out of a connector mounting hole in the vehicle's body and a female connector connected through a grommet in the door. The male connector is typically coupled to the female connector to transmit various electric signals from the vehicle body to the vehicle door. After the female connector and the male connector are coupled together there are typically four protruders formed at the external surface of the female connector for insertion into a connector mounting hole in the vehicle body.

The grommet connected to the female connector is tightly attached to the connector mounting hole thereby tightly sealing the hole to prevent water leakage into either the door or the vehicle. However, often the female connector fails to provide a force sufficient to fasten the connectors and perform the sealing function. Thereby, vibration and noise is created. Furthermore, after the four protruders are inserted into the vehicle body, it is difficult to detach them from the vehicle body without damaging them. Therefore, repair time efficiency is negatively effected and costs are increased because the connector must be replaced. Another drawback in the conventional vehicle door connector structure in that wires are often damaged by the connector mounting hole, bringing about an electric shortage.

SUMMARY OF THE INVENTION

The present invention provides a vehicle door connector structure that can be conveniently and firmly fastened to a vehicle body, thereby securing a tight seal between the vehicle body and the door connector preventing noise and vibration and reducing repair time and costs.

In accordance with an embodiment of the present invention, a vehicle door connector structure comprises a female connector unit and a male connector unit. The male connector unit protrudes from and is fixed to the body of the vehicle and a slide holder is rotatably mounted to the female connector unit. The slide holder couples with the male connector unit and closely attaches to a vehicle body panel. Thus producing an electrical connection between the terminals of the female connector unit and those of the male connector unit.

In an alternative embodiment an electrical connector for a vehicle door comprises a male connector configured for insertion and mounting in a hole through a vehicle panel wherein the male connector defines a peripheral screw thread groove adjacent one end. Furthermore, a female connector is configured for receiving the male connector wherein the female connector contains terminals for engaging wires of the vehicle door and defines a peripherial connection groove adjacent an end. Also included is a slide holder rotatably receiving the female connector through engagement of a latching jaw into the connection groove and having internally protruding pins configured to rotatably engage the screw thread grooves in the male connector.

Preferably, the male connector comprises a connector portion with a body part configured to extend through an opening in a body panel and a panel bracket defining an opening configured to receive and lock onto the body part.

BRIEF DESCRIPTION OF THE DRAWINGS

For fuller understanding of the nature and objects of the invention, reference should be made to the following detailed description taken in conjunction with the accompanying drawings in which.

DETAILED DESCRIPTION OF THE INVENTION

As shown in FIGS. 1–4, a male connector unit 3 passes through a vehicle body panel 1 and protrudes with a plurality of terminals therein. A female connector unit 5 is coupled to the terminals of the male connector unit 3 with a plurality of terminals to transmit electric signals. A slide holder 7 is rotatably mounted on the female connector unit 5. The slide holder 7 is connected to the male connector unit 3, and closely attached to the vehicle body panel 1, by rotation.

Figure 1:
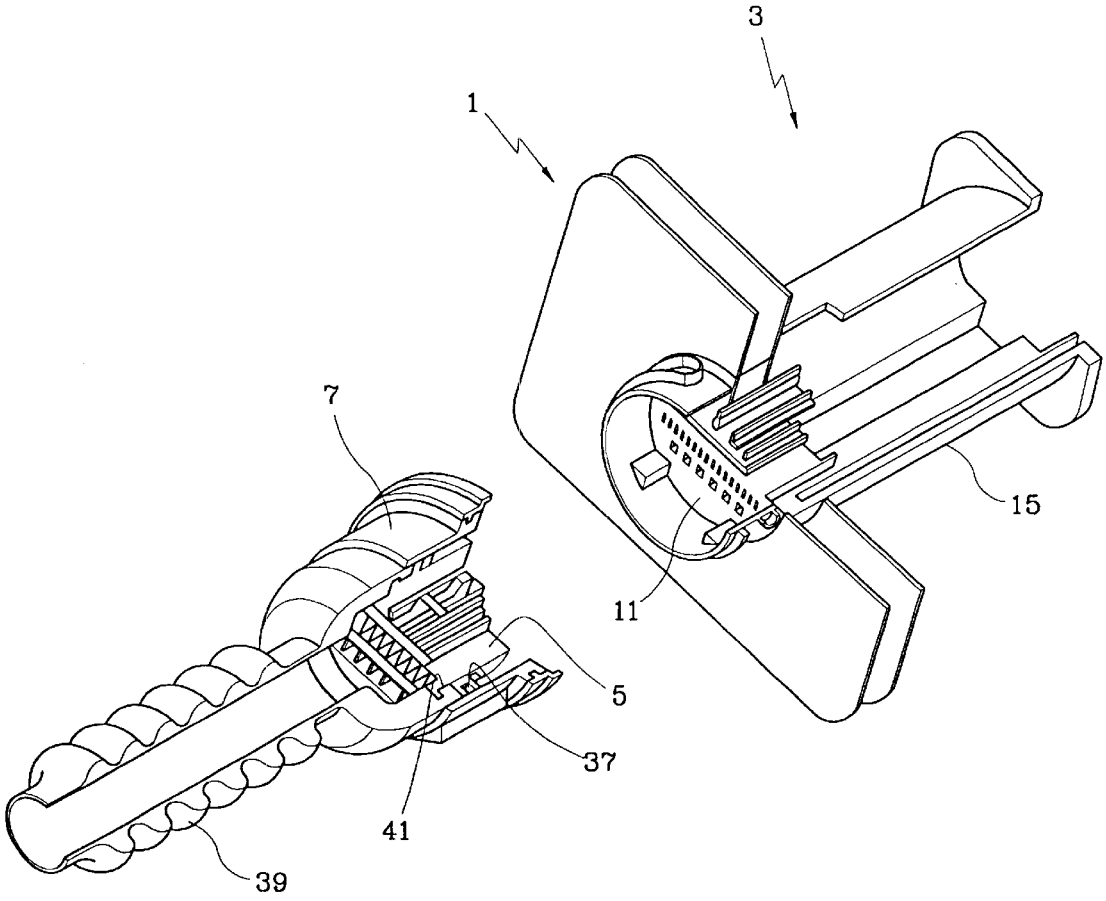
FIG. 1 is an exploded perspective view illustrating an embodiment of a vehicle door connector structure in accordance with an embodiment of the present invention.
Figure 2:
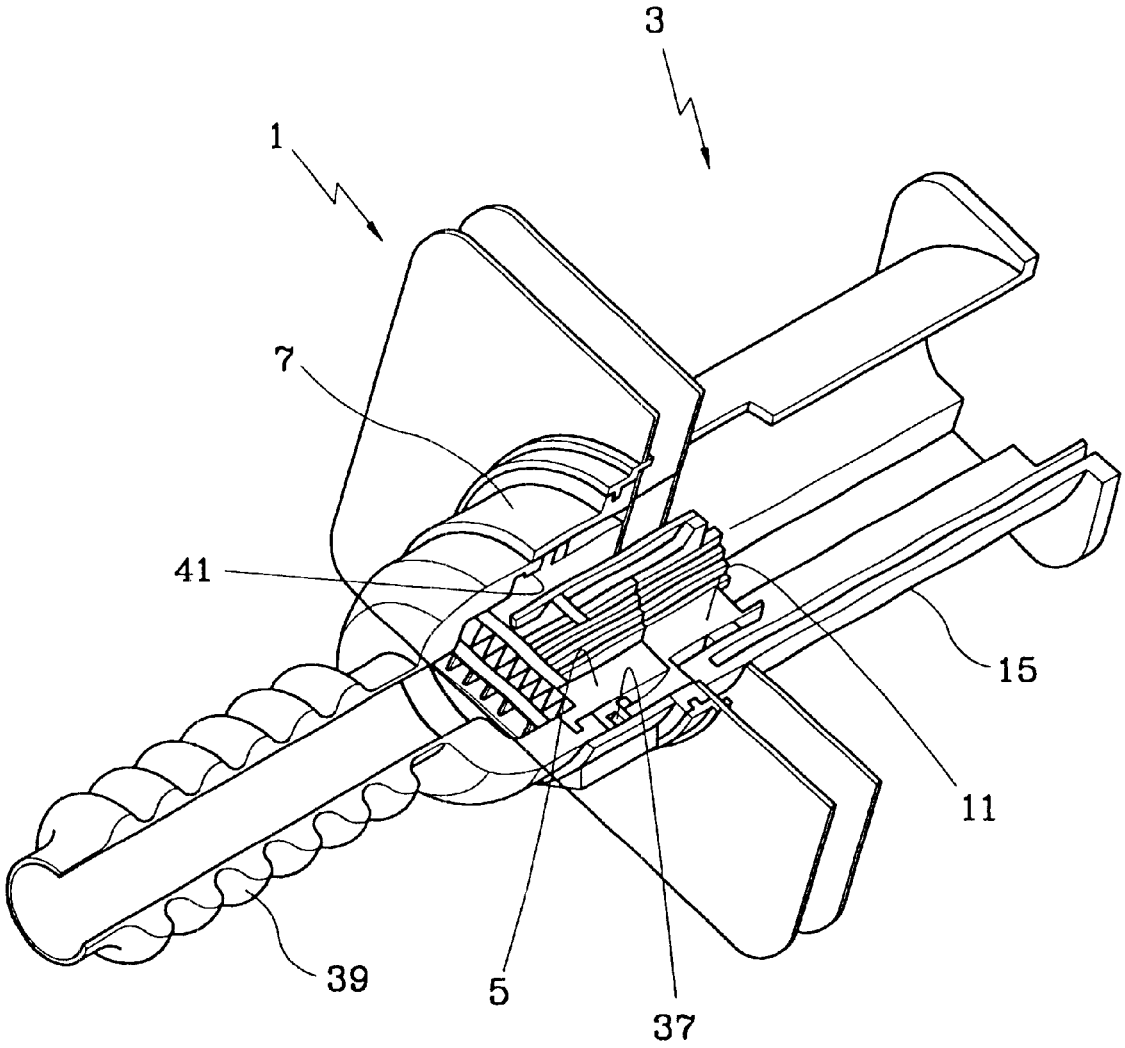
FIG. 2 illustrates a coupled state of the vehicle door connector structure of FIG. 1.
Figure 3:
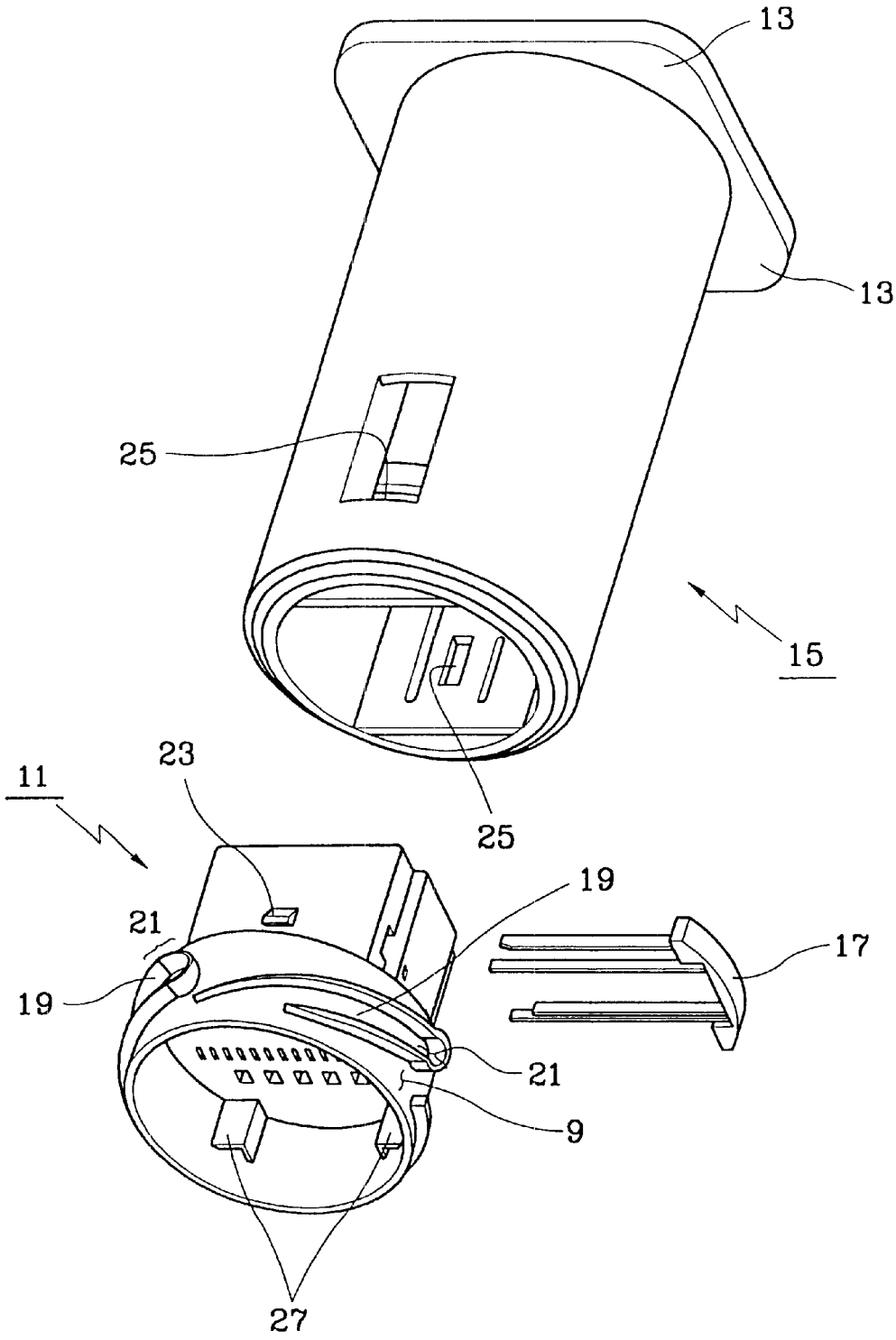
FIG. 3 is an exploded perspective view illustrating the male connector unit of FIG. 1.

FIG. 3 shows the male connector unit 3. The male connector unit 3 is classified into two parts: a male connector 11 having a protruding part 9 that protrudes away from vehicle body panel 1 when the male connector unit 3 is inserted through the vehicle body panel 1; and a panel bracket 15 having a repulsive force support part 13 where the male connector 11 is inserted and supported. The repulsive force support part 13 forms a repulsive force from the opposite side of the vehicle body panel 1 when a slide holder 7 is closely attached to one side of the vehicle body panel 1.

In a preferable embodiment a side spacer 17 (FIG. 3) is inserted into the side of the male connector 11 to keep the plurality of inserted terminals stable. Three screw-type coupling grooves 19 are arranged around the circumference of the protruding part 9 so that the slide holder 7 mounted on the female connector 5 is coupled to the coupling grooves 19 when rotated. A curvature changing part 21 is formed on an end of the coupling grooves 19 in order for the slide holder 7 to completely couple to the protruding part 9. The rear side of the protruding part 9 is inserted into and fixed at the panel bracket 15 via a fastening protruder 23. A fastening protruder fixing groove 25 is formed for fixation of the fastening protruder 23 at the panel bracket 15. Furthermore, there is an erroneous insertion preventing guide 27 integrally formed at the male connector 11 to guide the female connector 5 and prevent erroneous insertion.

Figure 4:
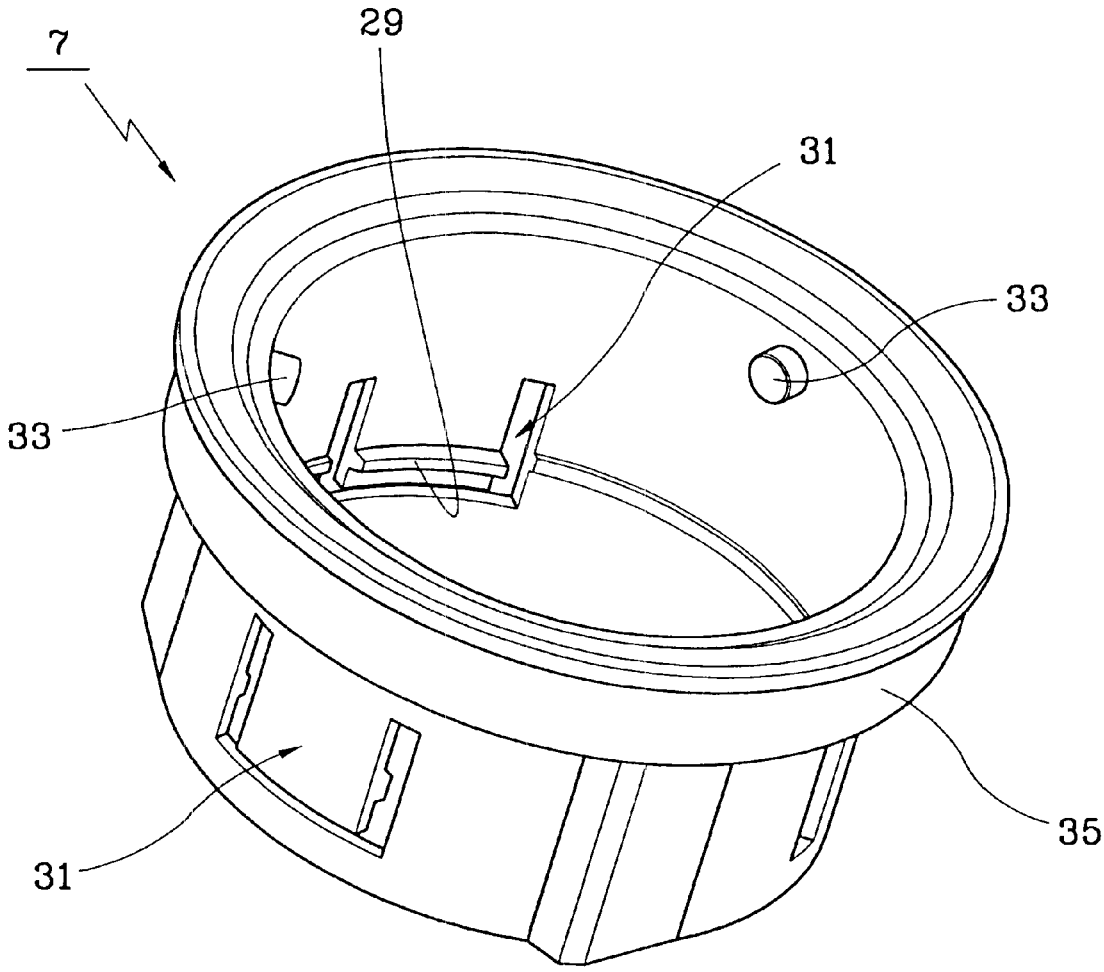
FIG. 4 is a perspective view illustrating the slide holder of FIG. 1.

FIG. 4 shows the slide holder 7. The slide holder 7 includes a resilience piece 31 having a latching jaw 29 formed along the circumferential direction of the female connector 5. The latching jaw 29 restricts relative motion along an axial direction of the slide holder 7 while allowing rotational movement. Three coupling protruders 33, formed on the inner circumference of the slide holder 7, are configured for coupling with the outer circumference of the protruding part 9 of the male connector 11. The three coupling protruders 33 couple the slide holder 7 with the male connector 11 by engaging the three screw-type coupling grooves 19. Rotation of the slide holder 7 activates the engagement, which seals the coupling through the seal 35. In use, when the slide holder 7 is inserted onto the female connector 5, the resilience piece 31 (FIG. 4) is elastically bent and then returned to its original position when the latching jaw 29 is inserted into a connecting groove 37.

The female connector 5 has a coupling groove 41 (FIG. 1) for coupling with the grommet 39 to secure a tight sealing and prevent water from leaking between the female connector 5 and the wires (not shown). Furthermore, it is preferable that the coupling groove 41 is wrapped and supported by the slide holder 7 following coupling of the connector, thereby further reducing the chance of water penetration.

Following coupling of the slide holder 7 with the male connector 11 the seal 35 (FIG. 4) forms a close attachment to the vehicle body panel 1 thereby preventing water from leaking into either the door or the vehicle. The seal 35 is maintained in close contact with both sides of the vehicle body panel 1. The repulsive force support part 13 (FIG. 3) of the panel bracket 5 also generates a force that helps to seal the male unit against the vehicle body. In use, as a result, the connector does not generate vibrations and noises.

Furthermore, the male connector unit 3, fixed on the panel 1, is coupled with the female connector 5 without extraction to prevent damage to the wires.

It is preferable that a rotation motion of the slide holder 7 unfastens the female connector 5 and the male connector 11. In use, the coupling protruders 33 slide in the screw thread like coupling grooves 19, thereby removing the slide holder 7 from the male connector 11.

The foregoing descriptions of specific embodiments of the present invention are presented for purposes of illustration and description. They are not intended to be exhaustive or to limit the invention to the precise forms disclosed. Many modifications and variations are possible in view of the above teachings. The embodiments were chosen and described in order to best explain the principles of the invention and its practical applications, and to enable others skilled in the art to best utilize the invention and various embodiments with various modifications as are suited to the particular use contemplated. It is intended that the scope of the invention be defined by the following claims and their equivalents.

What is claimed is:

1. A vehicle door electrical connector structure comprising:

a female connector unit;

a male connector unit protruding from and fixed to a vehicle body panel; and a slide holder rotatably mounted to the female connector unit in order to couple with the male connector unit and closely engaging to the vehicle body panel for electrical connection between the terminals of the female connector unit and those of the male connector unit.

2. The structure as defined in claim 1, wherein the male connector comprises:

a male connector having a protruded part that protrudes out of the vehicle body panel when the male connector is coupled to the vehicle body panel; and a panel bracket having a repulsive force support part, where the male connector is inserted and supported, to form a repulsive force from an opposite side of the vehicle body panel when the slide holder is tightly attached to one side of the vehicle body panel.

3. The connector as defined in claim 2, wherein the slide holder comprises:

a resilience piece having a latching jaw formed along the circumferential direction of the female connector to thereby restrict relative motion toward a axial direction of the slide holder and allow for rotational movement;

a plurality of coupling protruders protruded along the inner circumference thereof to be coupled to the outer circumference of the protruded parts of the male connector by rotation: and a seal integrally formed at one end thereof in contact with the panel coupled and closely attached to the male connector.

4. The structure as defined in claim 2, wherein the male connector integrally comprises:

a coupling protruder for coupling the panel bracket; and a plurality of screw-shaped coupling grooves formed at the circumference thereof in order for the slide holder to be rotated and coupled thereto.

5. The structure as defined in claim 4, wherein the mail connector is formed with an erroneous insertion preventing guide to guide the female connector and prevent erroneous insertion.

6. The connector as defined in claim 4, wherein the screw-shaped coupling grooves have a curvature changing part at an end thereof to completely couple with the slide holder.

7. An electrical connector for a vehicle door, comprising:

a male connector configured for insertion and mounting in a hole through a vehicle panel wherein said male connector defining a peripheral screw thread groove adjacent one end;

a female connector configured for receiving said male connector wherein said female connector contains terminals for engaging wires of said vehicle door and defines a peripherial connection groove adjacent an end; and a slide holder rotatably receiving said female connector through engagement of a latching jaw into the connection groove and having internally protruding pins configured to rotatably engage the screw thread grooves in said male connector; and a seal configured on said slide holder for sealing against a vehicle panel.

8. The connector of claim 7, further comprising a grommet configured to couple with said female connector.

9. The connector of claim 7, wherein the male connector comprises:

a connector portion with a body part configured to extend through an opening in a body panel; and a panel bracket defining an opening configured to receive and lock onto said body part.

10. An electrical connector for a vehicle door, comprising:

a male connector configured for insertion and mounting in a hole through a vehicle panel wherein said male connector defining a peripheral screw thread groove adjacent one end;

a female connector configured for receiving said male connector wherein said female connector contains terminals for engaging wires of said vehicle door and defines a peripherial connection groove adjacent an end;

a slide holder rotatably receiving said female connector through engagement of a latching jaw into the connection groove and having internally protruding pins configured to rotatably engage the screw thread grooves in said male connector; and a grommet configured to couple with said female connector.

* * * * *